United States Patent [19]

Okutsu et al.

[11] Patent Number: 4,859,567

[45] Date of Patent: Aug. 22, 1989

[54] METHOD OF FORMING HIGH CONTRAST NEGATIVE IMAGES

[75] Inventors: Eiichi Okutsu; Mitsunori Hirano, both of Kanagawa, Japan

[73] Assignee: Fuji Photo Film Co., Ltd., Kanagawa, Japan

[21] Appl. No.: 129,632

[22] Filed: Dec. 7, 1987

[30] Foreign Application Priority Data

Dec. 5, 1986 [JP] Japan ..... 61-289918

[51] Int. Cl.[4] ..... G03C 1/06; G03C 5/24

[52] U.S. Cl. ..... 430/265; 430/267; 430/268

[58] Field of Search ..... 430/265, 267, 268

[56] References Cited

U.S. PATENT DOCUMENTS

| | | | |
|---|---|---|---|
| 4,569,904 | 2/1986 | Okutsu et al. | 430/268 |
| 4,619,886 | 10/1986 | Okutsu et al. | 430/265 |
| 4,668,605 | 5/1987 | Okutsu et al. | 430/268 |
| 4,740,452 | 4/1988 | Okutsu et al. | 430/265 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method of forming a high contrast negative image is disclosed, comprising developing an imagewise exposed substantially surface latent image-type silver halide photographic material in the presence of a hydrazine derivative with a developer, said developer having a pH of 10.5 to 12.3 and containing (1) a developing agent, (2) not less than 0.25 mol/liter of a sulfite, (3) a compound represented by formula (I):

$$Ar—R_1)n \quad (I),$$

wherein Ar represents an aryl group, and $R_1$ represents an alkyl group or an alkoxy group and n is an integer of from 1 to 3, and (4) a compound represented by formula (II):

$$R_2—SO_3M \quad (II),$$

or a compound represented by formula (III):

$$R_3—COOM \quad (III),$$

wherein M represents a hydrogen atom, Na, K or $NH_4$, and $R_2$ and $R_3$ each represents an alkyl group having at least 3 carbon atoms, an aryl group or a heterocyclic group.

10 Claims, No Drawings

METHOD OF FORMING HIGH CONTRAST NEGATIVE IMAGES

FIELD OF THE INVENTION

The present invention relates to a method of forming images using a silver halide photographic material. More particularly it is concerned with a method whereby high contrast negative images which are useful in the field of graphic arts can be formed in a short time using a stable developer.

BACKGROUND OF THE INVENTION

In the field of the graphic arts, to improve the reproduction of images having a continuous gradation of dot images or the reproduction of line images, an image forming system is needed which provides images having high contrast (gamma: not less than 10).

For this purpose, a special developer called a lith developer has been used. The lith developer contains only hydroquinone as a developing agent and the concentration of free sulfurous acid ions in the lith developer is greatly decreased by using sulfites as a preservative in the form of an adduct with formaldehyde so that they do not inhibit infectious developing properties. The lith developer is readily subject to air oxidation. The fact that it cannot be stored for more than 3 days is a serious disadvantage.

As a method for obtaining photographic characteristics of super high contrast using a stable developer, a method using hydrazine derivatives, as described in, for example, U.S. Pat. Nos. 4,224,401, 4,168,977, 4,166,742, 4,311,781, 4,272,606, 4,221,857 and 4,243,739, is known. In accordance with this method, photographic characteristics of high contrast and high sensitivity can be obtained and since a high concentration of sulfite can be added to the developer, the stability of the developer against air oxidation is greatly increased in comparison with the lith developer.

However, in order to obtain photographic characteristics of high contrast and high sensitivity, a relatively long developing time is needed. For example, in the examples of the above U.S. Patents, a developing time ranging between 1 minute and 3 minutes is usually employed. There is tendency that as the pH value of the developer decreases, a longer developing time is needed.

In the field of graphic arts, stabilization of the developer and acceleration of processing have been strongly desired in recent years. Thus it is very important to solve the above problem.

Among the methods to directly obtain positive images by the color diffusion transfer method is a method using a combination of internal latent image type emulsion and hydrazine derivatives.

This combination, however, fails to provide negative images of high contrast to the extent that the present invention is intended to provide.

U.S. Pat. No. 3,846,129 discloses a color diffusion transfer method using a combination of hydrazine derivatives as described above and internal latent image type emulsions in which an aromatic alcohol dye booster is added to a para-phenylenediamine-type viscous developer along with a competing developer.

In this method, however, aromatic alcohols are considered to act as agents which accelerate the transfer of formed dyes. The mutual action of the aromatic alcohols with hydrazine derivatives is not at all suggested.

A method is known in which aromatic alcohols, specifically those described in Japanese Patent Application (OPI) No. 200250/85 (the term "OPI" as used herein means a "published unexamined Japanese patent application") are added to a developer to be used in the system using hydrazine derivatives. In fact, however, the solubility of the aromatic alcohols is, however, not sufficiently high to dissolve more than a small amount. Thus they are used in only a small amount within the concentration range in which they can be dissolved.

SUMMARY OF THE INVENTION

An object of the present invention is to provide a method whereby in forming high contrast negative images with a stable developer using hydrazine derivatives, the developing time can be shortened.

It has been found that this object is attained by using a developer having a pH of 10.5 to 12.3 and containing at least (1) a developing agent, (2) nor less than 0.25 mol/liter of sulfite, (3) a compound represented by formula (I) as described hereinafter, and (4) a compound represented by formula (II) or (III) as described hereinafter.

The present invention relates to a method for forming a high contrast negative image, which comprises developing an imagewise-exposed and substantially surface latent image-type silver halide photographic material in the presence of a hydrazine derivative with a developer, the developer having a pH of 10.5 to 12.3 and containing at least one developer having a pH of 10.5 to 12.3 and containing (1) a developing agent, (2) not less than 0.25 mol/liter of a sulfite, (3) a compound represented by the following formula (I):

$$Ar—(R_1)_n \quad (I),$$

wherein Ar represents an aryl group, and $R_1$ represents an alkyl group or an alkoxy group and n is an integer of from 1 to 3, and (4) a compound represented by the following general formula (II):

$$R_2—SO_3M \quad (II),$$

or a compound represented by the following formula (III):

$$R_3—COOM \quad (III),$$

wherein M represents a hydrogen atom, Na, K or $NH_4$, and $R_2$ and $R_3$ each represents an alkyl group having at least 3 carbon atoms, an aryl group or a heterocyclic group.

DETAILED DESCRIPTION OF THE INVENTION

If compounds generally known as solvents, such as ethylene glycols, are used, the above object cannot be attained. On the other hand, if the compounds of formula (II) or (III) are used, the above object is attained without losing the advantages of the image forming method using hydrazine derivatives.

The formula (I) will hereinafter be explained in detail.

The aryl group represented by Ar includes a substituted aryl group and an unsubstituted aryl group. Examples of such substituents are a methyl group, an ethyl group and a halogen substituted group. The aryl group represented by Ar is preferably a phenyl group or a substituted phenyl group.

The alkyl group represented by $R^1$ includes a substituted alkyl group and an unsubstituted alkyl group. Examples of such substituents are a hydroxyl group, a carboxyl group, and the like. Particularly preferred is a hydroxyl group.

As the alkyl group and the alkoxy group represented by $R^1$, those having not more than 4 carbon atoms are preferred. Particularly preferred are a methoxy group, an ethoxy group, a hydroxymethyl group and a hydroxyethyl group.

The formulae (II) and (III) will hereinafter be explained in detail.

The $R_2$ and $R_3$ each represents an alkyl group, an aryl group or a heterocyclic group which may be substituted or unsubstituted. Examples of such substituents are a hydroxyl group and a halogen substituted group.

The heterocyclic group may, for example, contain 1 to 4 hetero atoms selected from nitrogen, oxygen and sulfur atoms as ring atoms and may contain from 4 to 10 ring members. An example of the heterocyclic group is a pyridine group The number of carbon atoms of the groups represented by $R_2$ and $R_3$ is preferably in the range from 4 to 15. Preferred examples of R2 and R3 are an alkyl group (e.g., a pentyl group, a heptyl group and an octyl group), a phenyl group, and a phenyl group substituted by an alkyl group or alkoxy group (e.g., a methyl group, an ethyl group and a methoxy group).

Representative examples of the compounds represented by formula (I) are shown below although the present invention is not limited thereto.

I-1

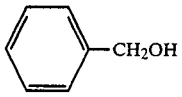

I-2

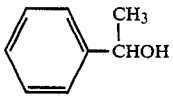

I-3

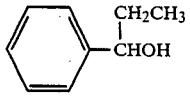

I-4

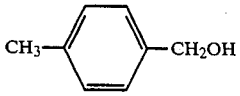

I-5

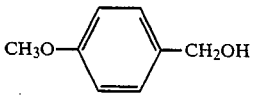

I-6

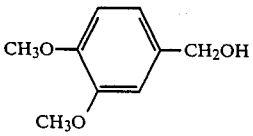

-continued

I-7

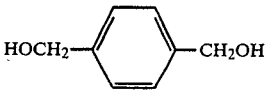

I-8

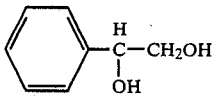

I-9

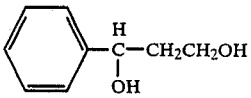

I-10

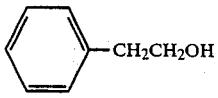

I-11

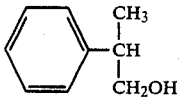

I-12

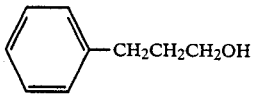

I-13

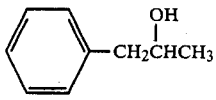

I-14

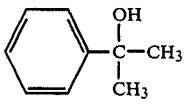

I-15

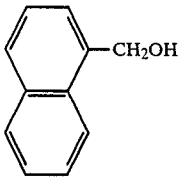

Representative examples of the compounds represented by formula (II) are shown below although the present invention is not limited thereto.

II-1: Sodium p-toluenesulfonate
II-2: Sodium o-toluenesulfonate
II-3: Potassium p-toluenesulfonate
II-4: p-Toluenesulfonic acid
II-5: Benzenesulfonic acid
II-6: Sodium benzenesulfonate
II-7: Sodium 1-naphthylsulfonate Representative examples of the compounds represented by formula (III) are shown below although the present invention is not limited thereto.

III-1: Sodium benzoate
III-2: Potassium benzoate
III-3: Benzoic acid
III-4: Sodium p-toluinate
III-5: Potassium p-toluinate III-6: Potassium isobutyrate
III-7: Sodium n-capronate
III-8: Potassium n-capronate
III-9: Sodium n-caprylate
III-10: Sodium n-caprate
III-11: Sodium nicotinate
III-12: Naphthoic acid
III-13: Salicyclic acid
III-14: Anisic acid The above compounds are all known and either are commercially available or can be prepared by known method.

The amount of the compound of formula (I) used is preferably 0.5 to 30 g per liter of the developer and more preferably 2 to 20 g per liter of the developer.

The amount of the compound of formula (II) or (III) used is preferably 0.1 to 50 g per liter of the developer and more preferably 1 to 30 g per liter of the developer.

In the image forming method of the present invention, the compound of formula (I) acts to accelerate the sensitization and contrast increasing action of hydrazine derivatives when a substantially surface latent image-type silver halide photographic material is exposed and developed in the presence of hydrazine derivatives, thereby shortening the necessary time for development.

In the prior art, as described above, as the pH of the developer decreases, the developing time is longer. If, however, the compound of formula (I) is used, processing can be completed in a short time while using a developer having a relatively low pH value (i.e., a pH of 10.5 to 12.3).

Japanese Patent Application (OPI) No. 200250/85 discloses that the demand for increasing the stabilization of the developer and for accelerating processing can be satisfied by using the compound of formula (I).

The compound of formula (I), however, is insufficiently soluble in the developer. Since the usual developer is a solution of a high electrolyte, the solubility of the compound of formula (I) is limited.

Thus the sensitization and contrast increasing action while developing in the presence of hydrazine derivatives is limited.

In order to exhibit the effect sufficiently, a technique for dissolving the compound of formula (I) in a higher concentration has been desired.

Moreover, when a highly concentrated developer is prepared, water may then be added thereto to prepare the developer for use in development, providing advantages such as reducing the cost of transportation of the developer product.

Ethylene glycol, diethylene glycol, triethylene glycol, etc. have been known as auxiliary dissolving agents for the compounds of formula (I).

It has been found by the present inventors, however, that if the compound of formula (II) or (III) is used, the solubility of the compound of formula (I) can be greatly increased and, thus, the sensitization and contrast increasing action can be greatly increased while developing in the presence of hydrazine derivatives and the preparation of concentrated developer can be realized.

In the image forming method of the present invention, it is preferred that as the developing agent, a dihydroxybenzene-type developing agent be used, and as the auxiliary developing agent, a p-aminophenol-type developing agent or a 3-pyrazolidone-type developing agent be used. In some cases, the auxiliary developing agent may not be used.

Dihydroxybenzene-type developing agents which may be used in the present invention include hydroquinone, chloro-hydroquinone, bromo-hydroquinone, isopropylhydroquinone, methylhydroquinone, 2,3-dichlorohydroquinone, 2,3-dibromohydroquinone, and 2,5-dimethylhydroquinone. Particularly preferred is hydroquinone.

Examples of the 1-phenyl-3-pyrazolidone or its derivatives as the auxiliary developing agent are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of the p-aminophenol-type auxiliary developing agent are N-methyl-p-aminophenol, p-aminophenol, N-(β-hydroxyethyl)-p-aminophenol, N-(4-hydroxyphenyl)glycine, 2-methyl-p-aminaphenol, and p-benzlaminophenol. Of these compounds, N-methyl-p-aminophenol is preferred.

The amount of the dihydroxybenzene-type developing agent used is preferably 0.05 to 0.8 mol/liter. When dihydroxybenzenes are used in combination with 1-phenyl-3-pyrazolidones or p-aminophenols, it is preferred that the former dihydroxybenzenes be used in an amount of 0.05 to 0.6 mol/liter and the latter 1-phenyl-3-pyrazolidones or p-aminophenols be used in an amount of not more than 0.06 mol/liter.

Sulfite preservatives which are used in the present invention include sodium sulfite, potassium sulfite, lithium sulfite, sodium hydrogen sulfite, potassium metahydrogen sulfite, and formaldehyde sodium hydrogen sulfite. The sulfite is used in an amount of not less than 0.25 mol/liter, preferably not less than 0.3 mol/liter. If the sulfite is used in a too large amount, it precipitates in the developer, thereby causing deterioration of the developer. Thus the upper limit is preferably 1.2 mol/liter.

The pH value of the developer of the present invention is within the range of 10.5 to 12.3. A more preferred pH range is from 11.0 to 12.0. As an alkali agent for adjusting the pH value, water-soluble inorganic alkali metal salts (e.g., sodium hydroxide, sodium carbonate, and potassium triphosphate) can usually be used.

The developer of the present invention may contain a pH buffer, e.g., boric acid, borax, sodium triphosphate and potassium triphosphate; a development inhibitor, e.g., potassium bromide and potassium iodide; an organic solvent, e.g., ethylene glycol, diethylene glycol, triethylene glycol, dimethylformamide, methyl cellosolve, hexylene glycol, ethanol, and methanol; and an antifoggant or black pepper-preventing agent, e.g., indazole compounds such a 5 nitroindazole and benzotriazole compounds such as 5-methylbenzotriazole.

When, in particular, compounds such as 5-nitroindazole are used, it is a common practice to previously dissolve the 5-nitroindazole in a portion different from that containing the dihydroxybenzene-type developing agent and the sulfite preservative and, when preparing the developer for use, both portions are mixed and water is added thereto. It is convenient from a standpoint of handling that the portion in which the 5-nitroindazole is to be dissolved is made alkaline, so that that portion has a yellow color.

In the developer of the present invention, as the pH buffer, compounds described in Japanese Patent Application (OPI) No. 93433/85 or Japanese Patent Application No. 28708/86, incorporated herein by reference, can be used.

In the developer of the present invention, as a silver stain preventing agent, compounds described in Japanese Patent Application (OPI) No. 24347/81 can be used.

To the developer of the present invention, in order to prevent development unevenness, compounds described in U.S. patent application Ser. No. 25,757 (filed on Mar. 13, 1987), incorporated herein by reference, can be added.

It is preferred that the developer of the present invention be stored in a wrapping material of low oxygen permeability as described in Japanese Patent Application (OPI) No. 73147/86 incorporated herein by reference. In the image forming method of the present invention, the replenishing system described in Japanese Patent Application (OPI) No. 91939/87 incorporated herein by reference is preferably used.

If necessary, the developer of the present invention may contain a color toning agent, a surfactant, a hard water softening agent, a hardener, etc.

As the fixing solution, those having the commonly used composition can be used. As the fixing agent, as well as thiosulfates and thiocyanates, organic sulfur compounds which are known to be effective as fixing agents can be used. As the oxidizing agent, an ethylenediaminetetraacetic acid iron (III) complex salt can be used.

The processing temperature may be in the range of from 18° to 50° C. Temperatures lower than 18° C. or temperatures higher than 50° C. may be employed.

The method of the present invention is particularly suitable for rapid processing using an automatic developing machine. As the automatic developing machine, any of roller conveyor, belt conveyor and the automatic developing machines can be used.

The processing time may be short. The method of the present invention is sufficiently effective for such rapid processing that the total processing time is not more than 2 minutes, particularly not more than 100 seconds, and the developing time is from 15 to 60 seconds.

As the hydrazine derivatives to be used in the present invention, the compounds represented by the following formula (IV) are preferred.

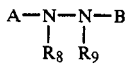

(IV)

In formula (IV), A represents a aliphatic group or an aromatic group.

B represents a formyl group, an acyl group, an alkyl- or arylsulfonyl group, an alkyl- or arylsulfinyl group, a carbamoyl group, an alkoxy- or aryloxycarbamoyl group, a sulfinamoyl group, an alkoxysulfonyl group, a thioacyl group, a thiocarbamoyl group, or a heterocyclic group.

$R_8$ and $R_9$ are both hydrogen atoms, or alternatively, one of them is a hydrogen atom and the other is a substituted or unsubstituted alkylsulfonyl group, a substituted or unsubstituted arylsulfonyl group, or a substituted or unsubstituted acyl group.

B, $R_9$ and the nitrogen atom -bonded thereto may form a partial structure of hydrazone,

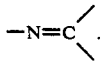

Particularly preferred as A is an aryl group.

In A of the formula (IV) may be incorporated a ballast group which is commonly used in a nondiffusible photographic additive such as a coupler. The ballast group is a group having not less than 8 carbon atoms which is relatively inert with regard to photographic properties. The ballast group can be chosen, for example, from an alkyl group, an alkoxy group, a phenyl group, an alkylphenyl group, a phenoxy group, an alkylphenoxy group, etc.

In A of formula (IV), a group increasing the adsorption onto the surface of silver halide grain may be incorporated. Such adsorption groups include a thiourea group, a heterocyclic thioamide group, a mercaptoheterocyclic group, and a triazole group.

B of formula (IV) may combine together with $R_9$ and the nitrogen atom to which B and R9 are bonded to form a partial structure Of hydrazone,

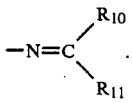

In the above formula, $R_{10}$ represents an alkyl group, an aryl group, or a heterocyclic group. $R_1$represents a hydrogen atom, an alkyl group, an aryl group, or a heterocyclic group.

As $R_8$ and $R_9$, a hydrogen atom is most preferred.

Representative examples of the hydrazine derivatives represented by formula (IV) are shown below although the present invention is not limited thereto.

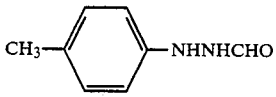

IV-1

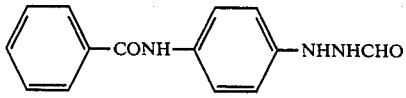

IV-2

-continued
IV-3
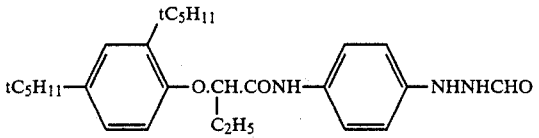
IV-4
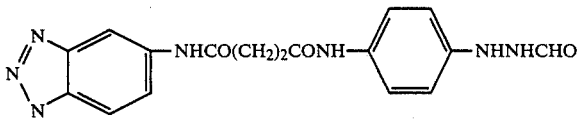
IV-5
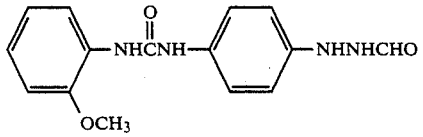
IV-6
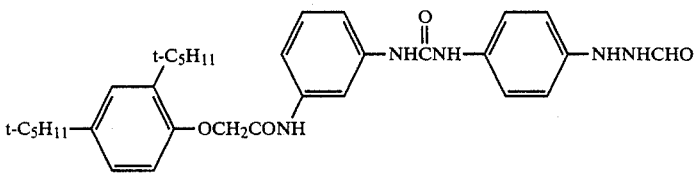
IV-7
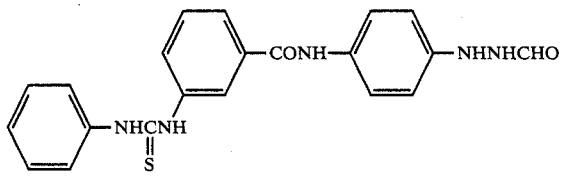
IV-8
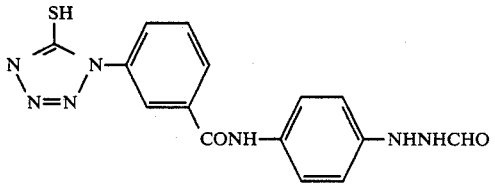
IV-9
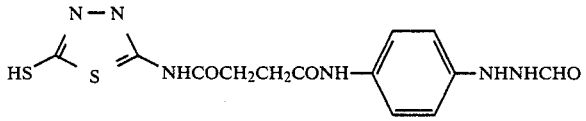
IV-10
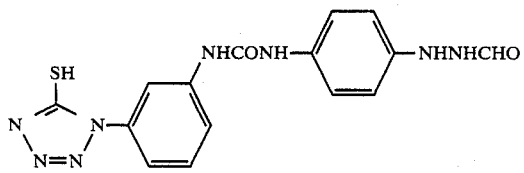
IV-11
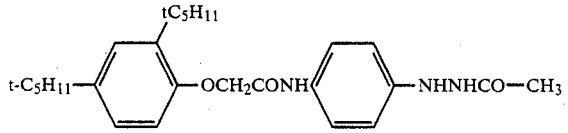
IV-12
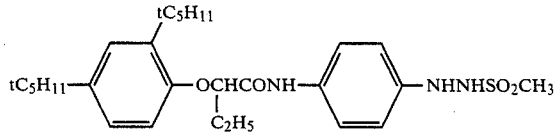

-continued

IV-13

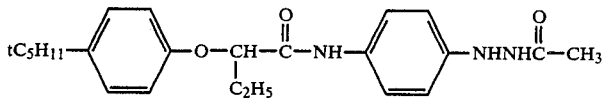

IV-14

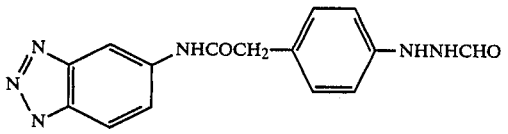

IV-15

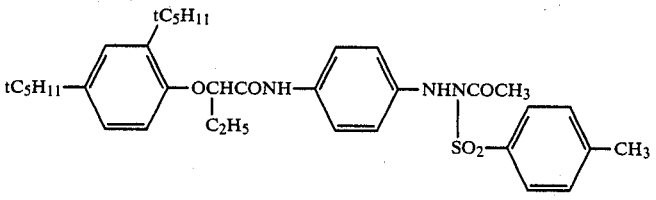

IV-16

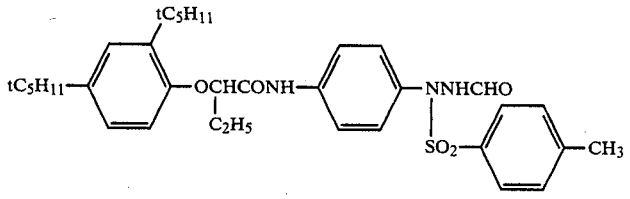

IV-17

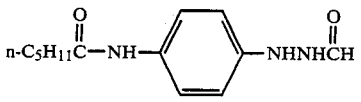

IV-18

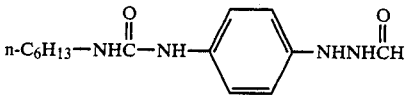

IV-19

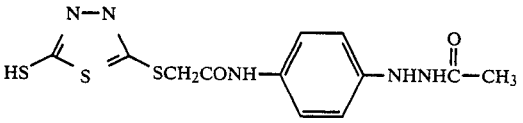

IV-20

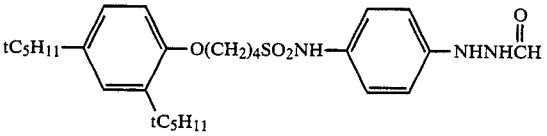

IV-21

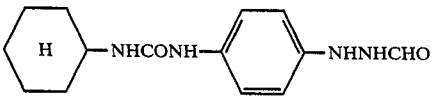

It is preferred for the hydrazine derivatives to be incorporated into a silver halide emulsion layer of the photographic material. In addition, they may be incorporated in light-insensitive hydrophilic colloid layers other than the silver halide emulsion layer, such as a protective layer, an intermediate layer, and an antihalation layer.

More specifically, if the compound used is soluble in water, it is added to the hydrophilic colloid solution in the form of an aqueous solution, whereas if it is sparingly soluble in water, it is added to the hydrophilic colloid solution in the form of a solution in organic solvents miscible with water, such as alcohols, esters and ketones.

When the hydrazine derivatives are added to the silver halide emulsion layer, they may be added at any desired stage from the start of chemical ripening to prior to coating. Preferably they are added during the period from the end of chemical ripening to prior to coating. Particularly preferably they are added to a coating solution prepared for coating.

The optimum amount of hydrazine derivatives added is desirably determined depending on the grain diameter of the silver halide emulsion, the halogen composition, the method and extent of chemical sensitization, the relation between the layer in which the compounds are to be added and the silver halide emulsion layer, the type of antifoggant, and so on. This choice can be made by testing methods well known to one skilled in the art.

The amount of hydrazine derivatives added is preferably $1\times10^{-6}$ to $1\times10^{-1}$ mol, particularly preferably $1\times10^{-5}$ to $4\times10^{-2}$ mol per mol of silver halide.

Moreover, the hydrazine derivatives can be incorporated in the developer. In this case, the amount of the hydrazine derivatives added is preferably 5 mg to 5 g, particularly preferably 10 mg to 1 g, per liter of the developer.

The silver halide photographic material to be used in the image forming method of the present invention will hereinafter be explained.

The halogen composition of the silver halide emulsion to be used in the present invention is not critical. Any of silver chloride, silver chlorobromide, silver iodobromide, silver bromide, silver iodobromochloride, and the like can be used. The silver iodide content is preferably not more than 5 mol % and particularly preferably not more than 3 mol %.

Silver halide grains contained in the photographic emulsion which is used in the present invention preferably have a narrow grain size distribution, although they may have a relatively broad grain size distribution. It is particularly preferred that the size of grains constituting 90%, either by weight or by number, of all silver halide grains falls within the range of the mean grain size ±40%. In general, such an emulsion is called a monodispersed emulsion.

Silver halide grains to be used in the present invention are preferably fine grains having a grain size of not more than 0.7 μm, particularly preferably a grain size of not more than 0.4 μm.

Silver halide grains contained in the photographic emulsion may be grains having a regular crystal form, such as cubic and octahedral, or grains having an irregular crystal form, such as spherical and tabular, or grains having a composite crystal form thereof.

Silver halide grains may be such that the inner portion and the surface layer are of uniform composition or such that they are different in composition.

Two or more silver halide emulsions which have been prepared separately can be used in admixture with each other.

In the silver halide emulsion to be used in the present invention, cadmium salts, sulfurous acid salts, lead salts, thallium salts, iridium salts or its complex salts, rhodium salts or its complex salts, and so on may be permitted to coexist during the process of formation or physical ripening of silver halide grains.

As the silver halide emulsion, an emulsion which has not been subjected to chemical sensitization, i.e., a so-called primitive emulsion, can be used. The silver halide emulsion may also be one that has been subjected to chemical sensitization.

As a binder or protective colloid for use in the emulsion layer or intermediate layer of the photographic material of the present invention, it is advantageous to use gelatin. Other hydrophilic colloids can also be used.

The photographic emulsion used in the present invention may be subjected to spectral sensitization using methine dyes and so on. Dyes which may be used include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes, and composite merocyanine dyes. These dyes can be used in combination with each other so that a super sensitization effect can be obtained.

In combination with sensitizing dyes, dyes not having spectral sensitization action by themselves, or substances not substantially absorbing visible light, but exhibiting super sensitization, may be incorporated in the emulsion.

In the photographic emulsion of the present invention, various compounds can be incorporated for the purpose of preventing fog during the preparation, storage or photographic processing of the photographic material, or for stabilizing photographic performance.

Particularly preferred are benzotriazoles (e.g., 5-methylbenzotriazole) and nitroindazoles (e.g., 5-nitroindazole). These compounds may be incorporated in the processing solution.

As the light-sensitive material to be used in the present invention, light-sensitive materials described in Japanese Patent Application (OPI) Nos. 29837/86, 223738/86, and 235947/87 and West German Patent Application (OLS) No. 3710625, and a bright room-type light-sensitive materials as described in Japanese Patent Application (OPI) Nos. 238049/86 and 235938/87 and European Patent Application No.217260 A2 are preferably used.

As the support used for the silver halide photographic material according to the present invention, a flexible support is preferred and a support excellent in the flexibility and the dimensional stability, e.g., a polyethylene terephthalate film is particularly preferred.

The present invention is described in greater detail with reference to the following examples. Unless specified otherwise, all parts, percents, and ratios are by weight.

EXAMPLE 1

To a 0.3 μm mean grain size cubic silver iodobromide emulsion containing 2.5 mol % iodide were added 230 mg per mol of silver of sodium anhydro-5,5-dichloro-9-ethyl-3,3'-bis(3-sulfopropyl)-oxacarbocyanine hydroxide (sensitizing dye), 1.3 g per mol of silver of a hydrazine derivative (Compound IV-3), 300 mg per mol of silver of polyethylene glycol (molecular weight about 1,000), and, further, 5 methylbenzotriazole, 4-hydroxy-6-methyl-1,3,3a,7-tetraazaindene, a dispersion of polyethyl acrylate, and a 2-hydroxy-1,3,5-triazine sodium salt.

The coating solution thus obtained was coated on a polyethylene terephthalate film support in such a manner that the amount of silver coated was 4.0 g/m$^2$ and the amount of gelatin coated was 2.5 g/m$^2$, thereby forming Film A.

For comparison, Film B was prepared in the same manner as the preparation of Film A with the exception that the hydrazine derivative, Compound IV-3, was not added.

These films were exposed through an exposure wedge for sensitometry by the use of a 150 line magenta contact screen and, thereafter, was developed at 34° C. for 30 seconds with a developer having the composition as shown in Table 1 below, fixed, washed with water, and dried. The development process was carried out using an automatic developing machine Model FG660F manufactured by Fuji Photo Film Co., Ltd.

Photographic characteristics obtained when the processing was performed with developers shown in Table 1 below are shown in Table 2 below.

TABLE 1

| | C | D | E | F | G | H | J |
|---|---|---|---|---|---|---|---|
| Tetrasodium ethylenediamine-tetraacetate (g) | 1.0 | 1.0 | 1.0 | 1.0 | 1.0 | 1.0 | 1.0 |
| Sodium Hydroxide (g) | 9.0 | 9.0 | 9.0 | 9.0 | 9.0 | 9.0 | 9.0 |
| 5-Sulfosalycilic Acid (g) | 44.0 | 44.0 | 44.0 | 44.0 | 44.0 | 44.0 | 44.0 |
| Potassium Sulfite (g) | 100.0 | 100.0 | 100.0 | 100.0 | 100.0 | 100.0 | 100.0 |
| 5-Methylbenzotriazole (g) | 0.5 | 0.5 | 0.5 | 0.5 | 0.5 | 0.5 | 0.5 |
| Potassium Bromide (g) | 6.0 | 6.0 | 6.0 | 6.0 | 6.0 | 6.0 | 6.0 |
| N—methyl-p-aminophenol.½ $H_2SO_4$ (g) | 0.4 | 0.4 | 0.4 | 0.4 | 0.4 | 0.4 | 0.4 |
| Hydroquinone (g) | 54.0 | 54.0 | 54.0 | 54.0 | 54.0 | 54.0 | 54.0 |
| Compound of Formula I-1 (g) | 10.0 | 10.0 | 5.0 | 5.0 | — | — | — |
| Compound of Formula I-2 (g) | — | — | — | — | 3.0 | 3.0 | 3.0 |
| Compound of Formula II-1 (g) | — | 30.0 | — | — | — | 30.0 | — |
| Compound of Formula III-10 (g) | — | — | — | 30.0 | — | — | — |
| Diethylene Glycol (g) | — | — | — | — | — | — | 30.0 |
| Water to make (liter) | 1 | 1 | 1 | 1 | 1 | 1 | 1 |
| pH | 11.7 | 11.7 | 11.7 | 11.7 | 11.7 | 11.7 | 11.7 |
| Solubility | Compound of (I-1): Insoluble | Soluble | Compound of (I-1): Insoluble | Soluble | Compound of (I-2): Insoluble | Soluble | Compound of (I-2): Insoluble |
| Remarks | Comparison | Invention | Comparison | Invention | Comparison | Invention | Comparison |

TABLE 2

| Run No. | Remarks | Type of Film | Type of Developer | State in the Preparation | Photographic Characteristics: Sensitivity | $\overline{G}$ | Dot Quality |
|---|---|---|---|---|---|---|---|
| 1 | Comparison | A | C | Insoluble | 80 | 8 | 3 |
| 2 | Present Invention | A | D | Soluble | 100 | 15 | 5 |
| 3 | Comparison | A | E | Insoluble | 70 | 7 | 3 |
| 4 | Present Invention | A | F | Soluble | 95 | 15 | 5 |
| 5 | Comparison | A | G | Insoluble | 80 | 8 | 3 |
| 6 | Present Invention | A | H | Soluble | 100 | 15 | 5 |
| 7 | Comparison | A | J | Insoluble | 85 | 9 | 3 |
| 8 | Comparison | B | C | Insoluble | 20 | 4 | 1 |
| 9 | Comparison | B | D | Soluble | 20 | 4 | 1 |
| 10 | Comparison | B | E | Insoluble | 20 | 4 | 1 |
| 11 | Comparison | B | F | Soluble | 20 | 4 | 1 |
| 12 | Comparison | B | G | Insoluble | 20 | 4 | 1 |
| 13 | Comparison | B | H | Soluble | 20 | 4 | 1 |
| 14 | Comparison | B | J | Insoluble | 20 | 4 | 1 |

The sensitivity in Table 2 is a relative value of the reciprocal of exposure amount to provide an optical density of 1.5, with that of Run No. 2 (the case where Film A was processed with Developer D) as 100.

$\overline{G}$ is defined as the reciprocal of the amount of exposure to provide an optical density of 0.3 and 3.0, and the tan $\theta$ of the optical density.

The dot quality was evaluated visually and rated in five stages. "5" indicates the best dot quality, whereas "1" indicates the worst dot quality. As a dot original for photomechanical use, "5" and "4" indicate dot qualities which are satisfactory for practical use, "3" indicates a dot quality which is bad but usable, and "2" and "1" indicate dot qualities which are unsuitable for practical use.

As is apparent from the results of Table 2, when Developers C, E, G and J are used, sensitivity is low, $\overline{G}$ is small, and dot quality is bad because the compound of the general formula (I) is partially insoluble.

On the other hand, in Run Nos. 2, 4 and 6 in which Film A containing the hydrazine derivative was developed with Developers D, F and H of the present invention which contained a compound of formula (II) or (III) as an auxiliary dissolving agent for a compound of formula (I), sensitivity is high, $\overline{G}$ is large, and dot quality is good.

As shown in Run Nos. 8, 9, 10, 11, 12, 13 and 14, when a combination of a photographic material film and a developer both of which do not use hydrazine derivatives is employed, sensitivity is considerably low, $\overline{G}$ is considerably small and dot quality is considerably bad for any of the tested developers.

EXAMPLE 2

Evaluation was performed in the same manner as in Developer D of Example 1, except that the same amount of each of the compounds shown below was used in place of the compound (II-1).

Compound II-5.

Compound III-1.

Compound III-4.

Good results were obtained with each of Compounds II-5, III-1, and III-4 with regard to the solubility of the compound of formula (I) and with regard to the sensitivity, $\overline{G}$ and dot quality obtained.

As can be seen from the above results, when a compound of formula (II) or (III) is used in combination with a developer containing a compound of formula (I), a sufficiently high sensitivity can be obtained along with good gradation and good dot quality can be obtained.

While the invention has been described in detail and with reference to specific embodiments thereof, it will be apparent to one skilled in the art that various changes and modifications can be made therein without departing from the spirit and scope thereof.

What is claimed is:

1. A method of forming a high contrast negative image, which comprises developing an imagewise exposed substantially surface latent image-type silver halide photographic material in the presence of a hydrazine derivative with a developer, said developer having a pH of 10.5 to 12.3 and containing (1) a developing agent, (2) not less than 0.25 mol/liter of a sulfite, (3) a compound represented by formula (I):

$$Ar—(R_1)_n \quad (I),$$

wherein AR represents an aryl group, and $R_1$ represents an alkyl group or an alkoxy group and n is an integer of from 1 to 3, and (4) a compound represented by formula (II);

$$R_2—SO_3M \quad (II),$$

or a compound represented by formula (III):

$$R_3—COOM \quad (III),$$

wherein M represents a hydrogen atom, Na, K or $NH_4$, and $R_2$ and $R_3$ each represents an alkyl group having at least 3 carbon atoms, a phenyl group, or a phenyl group substituted by an alkyl group or alkoxy group.

2. A method as in claim 1, wherein:

$R_1$ of formula (1) contains from 1 to 4 carbon atoms; and $R_2$ and $R_3$ of formulae (II) and (III) contain from 4 to 15 carbon atoms.

3. A method as in claim 2, wherein:

Ar of formula (I) represents a substituted or unsubstituted phenyl group, $R_1$ of formula (I) represents a methoxy group, an ethoxy group, a hydroxymethyl group or a hydroxyethyl group, and $R_2$ and $R_3$ are selected from the group consisting of an alkyl group, a phenyl group, and a phenyl group substituted by an alkyl group or alkoxy group.

4. A method as in claim 1, wherein the amount of the compound of formula (I) is in the range from 0.5 to 30 g per liter of the developer, and the amount of the compound of formula (II) or formula (III) is in the range from 0.1 to 50 g per liter of the developer.

5. A method as in claim 1, wherein the developing agent is a dihydroxybenzene-type developing agent selected from the group consisting of hydroquinone, chloro-hydroquinone, bromo-hydroquinone, isopropylhydroquinone, methylhydroquinone, 2,3-dichlorohydroquinone, 2,3-dibromohydroquinone, and 2,5-dimethylhydroquinone.

6. A method as in claim 5, wherein the developer further contains a p-aminophenol-type developing agent or a 3-pyrazolidone-type developing agent.

7. A method as in claim 5, wherein the dihydroxybenzene-type developing agent is present in an amount in the range of from 0.05 to 0.8 mol per liter of the developer.

8. A method as in claim 6, wherein the dihydroxybenzene-type developing agent is present in an amount of from 0.05 to 0.6 mol per liter of the developer and the p-aminophenol-type developing agent or the 3-pyrazolidone-type developing agent is present in an amount of not more than 0.06 mol per liter of the developer.

9. A method as in claim 1, wherein the hydrazine derivative is a compound represented by formula (IV):

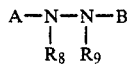

(IV)

wherein,

A represents an aliphatic group or an aromatic group,

B represents a formyl group, an acyl group, an alkyl- or arylsulfonyl group, an alkyl- or arylsulfinyl group, a carbamoyl group, an alkoxy- or aryloxycarbamoyl group, a sulfinamoyl group, an alkoxysulfonyl group, a thioacyl group, a thiocarbamoyl group, or a heterocyclic group, $R_8$ and $R_9$ are both hydrogen atoms or, alternatively, one of them is a hydrogen atom and the other is a substituted or unsubstituted alkylsulfonyl group, a substituted or unsubstituted arylsulfonyl group, or a substituted or unsubstituted acyl group, and B, $R_9$ and the nitrogen atom bonded thereto may form a partial structure of hydrazone represented by the formula

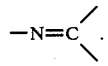

10. A method as in claim 1, wherein the developing time is from 15 to 60 seconds.

* * * * *